US005798637A

United States Patent [19]

Kim et al.

[11] Patent Number: 5,798,637

[45] Date of Patent: Aug. 25, 1998

[54] REFERENCE VOLTAGE GENERATING CIRCUIT

[75] Inventors: Daejeong Kim; Sungho Wang, both of Seoul, Rep. of Korea

[73] Assignee: LG Semicon Co., Ltd., Cheongju, Rep. of Korea

[21] Appl. No.: 668,891

[22] Filed: Jun. 24, 1996

[30] Foreign Application Priority Data

Jun. 22, 1995 [KR] Rep. of Korea ..... 1995 16866

[51] Int. Cl.[6] ..... G05F 3/24

[52] U.S. Cl. ..... 323/313; 323/315

[58] Field of Search ..... 323/313, 314, 323/315, 274, 284, 907, 961; 361/91

[56] References Cited

U.S. PATENT DOCUMENTS

| | | | |
|---|---|---|---|
| 3,859,563 | 1/1975 | Vogt | 315/241 P |
| 4,595,874 | 6/1986 | Hein et al. | 323/312 |
| 4,642,533 | 2/1987 | Carpenter | 315/408 |
| 4,825,142 | 4/1989 | Wang | 323/314 |
| 4,837,459 | 6/1989 | Bukowski et al. | 307/296.8 |
| 4,851,953 | 7/1989 | O'Neill et al. | 361/101 |
| 5,109,187 | 4/1992 | Gulliani | 323/313 |
| 5,212,440 | 5/1993 | Waller | 323/313 |
| 5,481,180 | 1/1996 | Ryat | 323/315 |

*Primary Examiner*—Adolf Berhane
*Attorney, Agent, or Firm*—Fleshner & Kim

[57] ABSTRACT

A reference voltage generating circuit of a semiconductor device includes a start-up circuit connected to a reference current generator, a substrate variation sensor and a temperature compensation current- to-voltage converter receiving outputs from the generator and sensor. The start-up circuit is connected to a reset terminal, for generating a driving signal determining an operating point of the reference voltage generating circuit. The reference current generator has a current mirror of a constant current source for receiving the driving signal from the start-up circuit and generating a reference current. The reference current generator includes a voltage divider for determining the reference current. The substrate voltage variation sensor compensates for a variation of the reference current caused by the variation of a substrate voltage. The current-to-voltage converter converts the reference current to a reference voltage; and the temperature compensator connected to the output terminal, compensates for the variation of the reference current due to the variation of temperature.

25 Claims, 3 Drawing Sheets

REFERENCE VOLTAGE GENERATING CIRCUIT

TECHNICAL FIELD

The present invention relates to reference voltage generating circuits, and more particularly, to a reference voltage generating circuit which compensates for back-bias and/or temperature variation.

BACKGROUND ART

FIG. 1 shows a conventional reference voltage generating circuit including a reference current generator 10 and a current-to-voltage converter 20. The reference current generator 10 receives a voltage applied from the exterior and generates a reference current. The reference current is supplied to a current mirror 12 from a reference current supply source 11. The reference current supply source 11 comprises two MOS transistors M1 and M2 and a resistor R, and the current mirror 12 includes serially connected MOS transistors M3, M5 and M6 which are connected in parallel to one another.

The current-to-voltage converter 20 generates a reference voltage based on the reference current received from the current mirror 12. The converter 20 includes a PMOS transistor M7 having a source electrode commonly connected to respective gate electrodes of the PMOS transistors M3 and M4 of the current mirror 12, a PMOS transistor M8 having a drain electrode connected to another reference current generator, and four PMOS transistors M9, M10, M11 and M12 serially connected between a supply voltage Vdd and the ground voltage Vss. The operation of PMOS transistor M9 is controlled by the PMOS transistors M7 and M8. The control signal "trimming" determines whether the reference current generator 10 is to be connected to the gate of M9.

The diode-connected PMOS transistors M10, M11 and M12 are connected to an output terminal together with a drain electrode of the PMOS transistor M9. The transistors M9–M12 suppress, by the square law of the MOS transistor, a variation in the reference current generated by the variation of a substrate voltage Vbb, so that a final reference voltage $V_{ref}$ becomes relatively less sensitive to the variation of the substrate voltage Vbb. The diode-connected PMOS transistors M10, M11 and M12 are connected in series for minimizing a standby current.

A current I flowing into one PMOS transistor of the current-to-voltage converter 20 is as follows:

$$I=W/L\cdot\beta_p\cdot(V_{GS}-|V_{TP}|)^2$$

where $V_{GS}$ is a gate-to-source voltage, and $V_{TP}$ is a threshold voltage of the PMOS transistor, $\beta_p$ is a current constant of the PMOS transistor, and W/L is a width-to-length ratio of the channel of the PMOS transistor. A voltage generated from the current I, i.e., the reference voltage $V_{ref}$, is proportional to a square root value of the current. If the reference current varies by ΔI according to the variation of the substrate voltage Vbb, and since the reference voltage $V_{ref}$ varies in proportion to square root of ΔI, the variation of the reference is relatively small.

An ideal reference voltage generating circuit should be able to generate a constant voltage, i.e., a reference voltage to be supplied to an internal circuit, irrespective of variations in a supply voltage, temperature and a substrate voltage. However, although the diode-connected PMOS transistors M10, M11 and M12 absorb the variation of the substrate voltage Vbb to some degree in the conventional reference voltage generating circuit, the compensation is not perfect under certain circumstances. Further, the variation of the reference voltage generated by the variation of temperature is not compensated.

As another example, a reference voltage generating circuit using a bandgap reference circuit or a circuit using the difference in the threshold voltages have been proposed. However, since one more mask is added to a standard N-well CMOS process, the process is more complex.

DISCLOSURE OF THE INVENTION

An advantage of the present invention is in eliminating the variation of a reference voltage due to substrate voltage variation.

Another advantage of the present invention is in compensation of the reference voltage in view of temperature effects.

The above and other advantages of the invention are achieved, at least in part, by a reference voltage generating circuit of a semiconductor device for receiving a supply voltage, generating a reference current, and converting the reference current to a reference voltage to be supplied to an output terminal includes: a start-up circuit connected to a reset terminal, for generating a driving signal determining an operating point of the reference voltage generating circuit; a reference current generator having a current mirror of a constant current source for receiving the driving signal from the start-up circuit and generating the reference current, and having a voltage divider for determining the reference current; a substrate voltage variation sensor connected to the output terminal, for compensating a variation of the reference current caused by the variation of a substrate voltage; a current-to-voltage converter for converting the reference current to the reference voltage; and a temperature compensator connected to the output terminal, for compensating the variation of the reference current according to the variation of temperature.

A circuit for generating a reference voltage comprising: current generator having a current mirror to generate a predetermined current in response to a first predetermined signal at a first node; a voltage sensor, coupled to the current generator at a second node, for detecting a variation in the predetermined current; and a converter having a first transistor coupled to the voltage sensor, and an output terminal, the first transistor being coupled to the current mirror such that the predetermined current flows through the first transistor, and a second transistor coupled to the first transistor, wherein the reference voltage at the output terminal is based on the predetermined current flowing through the first transistor, and the first transistor compensates for a variation of the reference voltage due to a temperature variation.

The above and other advantages of the invention are also achieved, at least in part, by a circuit for generating a reference voltage comprising: current generator having a current mirror to generate a predetermined current in response to a first predetermined signal at a first node; a voltage sensor having a first transistor coupled to a the current mirror of the current generator at a second node to detect a variation in the predetermined current; and a converter having a second transistor coupled to the first transistor of the voltage sensor, and an output terminal, and the second transistor coupled to the current mirror such that the predetermined current flows through the second transistor, wherein the reference voltage at the output terminal is based on the predetermined current flowing through the second transistor, and the first transistor absorbing the variation of the predetermined current due to a substrate bias voltage variation.

Additional advantages, objects and other features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

BEST MODE FOR CARRYING OUT THE INVENTION

Figure 1:
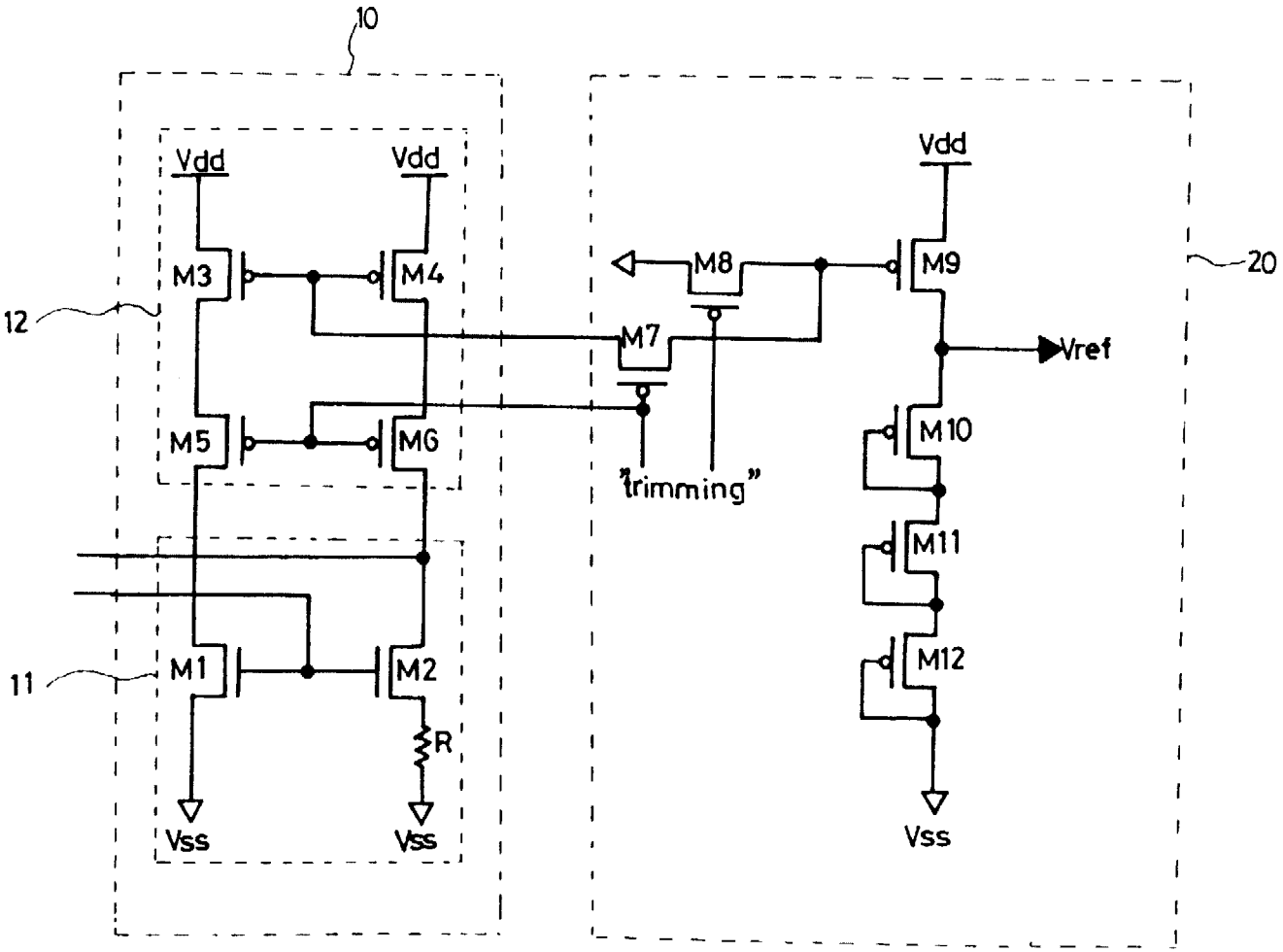
FIG.1(Prior Art)
FIG. 1 is a circuit diagram of a conventional reference voltage generating circuit.
Figure 2:
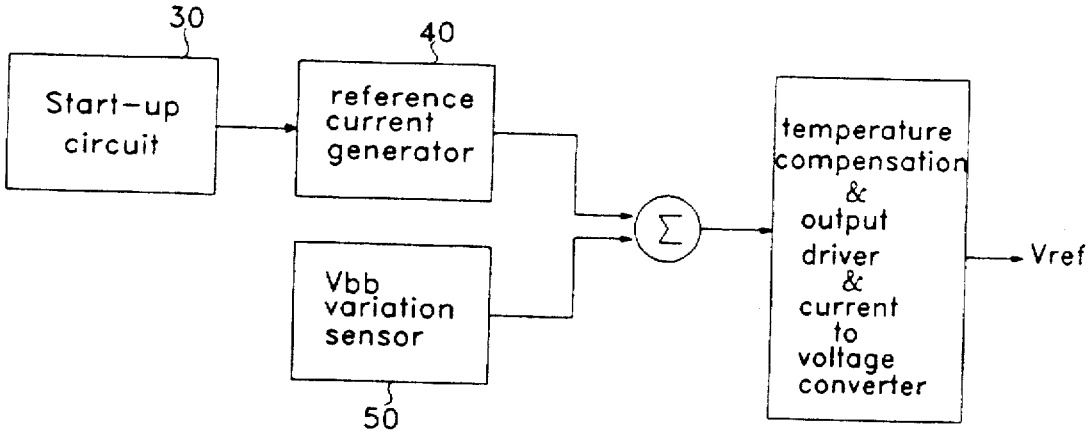
FIG. 2 is a block diagram of a reference voltage generating circuit according to the present invention.

Referring to FIG. 2, the reference voltage generating circuit comprises a start-up circuit 30, a reference current generator 40, a Vbb variation sensor 50 and converter 60. The start-up circuit facilitates the reference current generator 40 to have a desired operating point by supplying a current from the exterior when a power source is applied to the reference current generator 40. After supplying a driving voltage to the reference current generator 40 has been completed, the start-up circuit 30 is separated in operation from the reference current generator 40 and does not affect the circuit operation.

The reference current generator 40 supplies a constant current during a variation of a high level supply voltage Vdd. An output current I is not affected by the variation of the supply voltage Vdd, but is influenced by the variations of a substrate voltage Vbb and temperature. A substrate voltage variation sensor 50 senses a threshold voltage of a MOS transistor according to the variation of the substrate voltage Vbb and compensates a current variation ΔI of the reference current generator 40. A temperature compensator and current-to-voltage converter 60 converts a reference current to a reference voltage, lowers an output impedance and compensates the variation of the reference voltage due to temperature variations.

If a power source is supplied from the start-up circuit 30, the reference current generator 40 operates and generates the reference current. The temperature compensator and current-to-voltage converter 60 receives the reference current generated from the reference current generator 40 and from the substrate voltage variation sensor 50, and generates the reference voltage $V_{ref}$.

Figure 3:
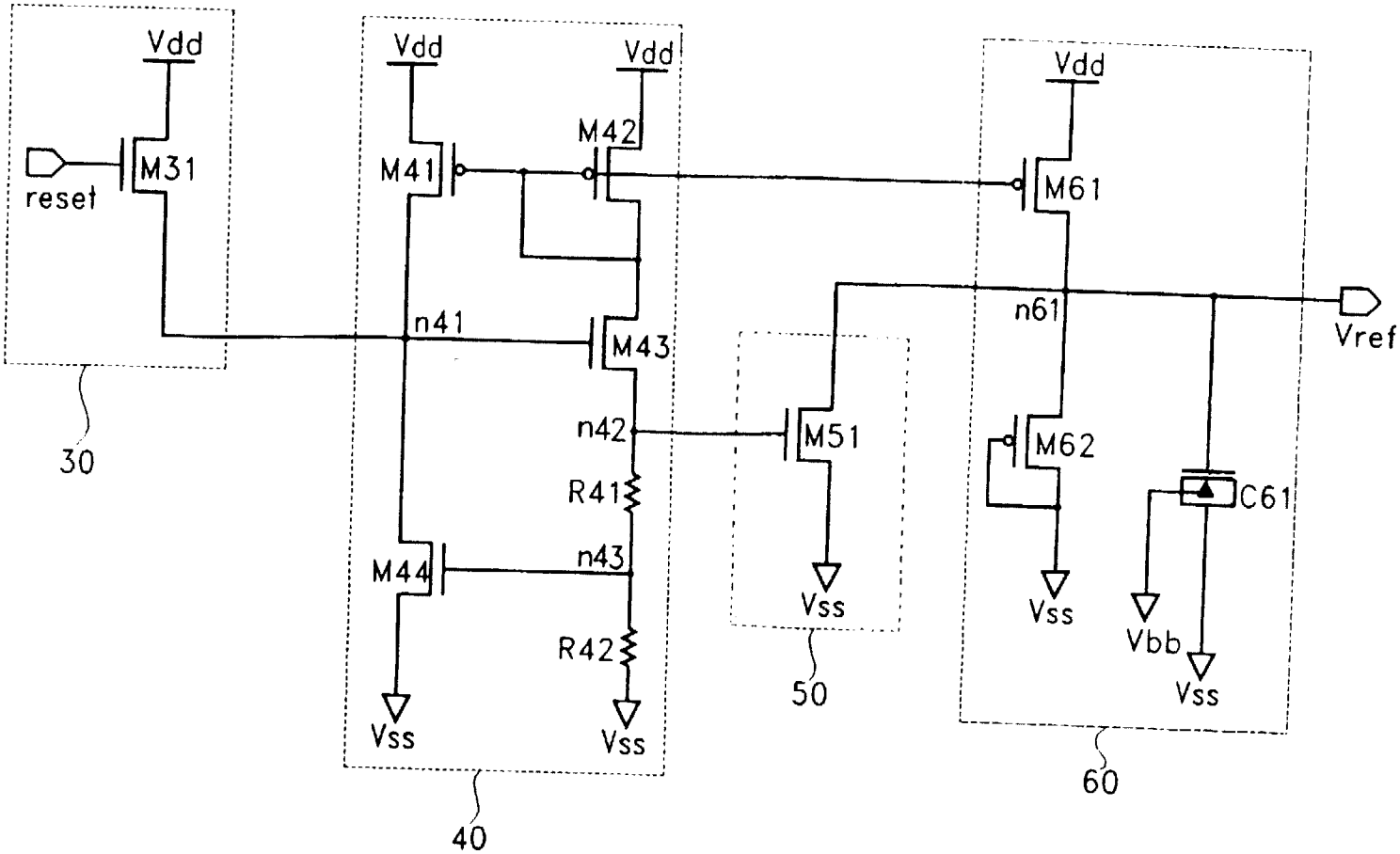
FIG. 3 is a circuit diagram of the reference voltage generating circuit of FIG. 2 according to the present invention.

Referring to FIG. 3, the start-up circuit 30 comprises first NMOS transistor M31. A drain electrode is connected to the supply voltage Vdd, and a source electrode is connected to a first node n41 of the reference current generator 40. A gate electrode is connected to a reset terminal.

The reference current generator 40 is broadly divided into a current mirror and a voltage divider. The current mirror includes first and second PMOS transistors M41 and M42. The source electrodes of transistors M41 and M42 are commonly connected to the supply voltage Vdd. A second NMOS transistor M43 has a drain electrode connected to a drain electrode of the second PMOS transistor M42, a gate electrode connected to the first node n41 and a source electrode connected to a second node n42.

The voltage divider includes a third NMOS transistor M44 and resistors R41 and R42. A drain electrode is connected to the first node n41, a gate electrode is connected to a third node n43 and a source electrode is connected to a ground voltage Vss. The first resistor R41 is connected between the second and third nodes n42 and n43, and the second resistor R42 is connected between the third node n43 and the ground voltage Vss.

The substrate voltage variation sensor 50 comprises a fourth NMOS transistor M51. A gate electrode is connected to the second node n42 of the reference current generator 40. A source electrode is connected to the ground voltage Vss, and a drain electrode is connected to an output node n61 of the temperature compensator and current-to-voltage converter 60. The substrate voltage variation sensor 50 uses a voltage of the second node n42 as a sensing voltage.

The temperature compensator and current-to-voltage converter 60, which adjusts for the variation of the reference voltage, includes third and fourth PMOS transistors M61 and M62 and a capacitor C61. A gate electrode of transistor M61 is commonly connected to gate electrodes of the first and second PMOS transistors M41 and M42; a source electrode is connected to the supply voltage Vdd; and a drain electrode is connected to the output node n61. A fourth PMOS transistor M62 has a source electrode connected to the output node n61 and gate and drain electrodes commonly connected to the ground voltage Vss. The capacitor C61 is connected between the output node n61 and the ground voltage Vss for suppression of noise at the output.

If a high voltage is supplied for a constant time from the reset terminal connected to the start-up circuit 30, the first NMOS transistor M31 is turned on and a current flows from the supply voltage Vdd. Hence, the voltage at the first node n41 is increased to initiate the operation of the reference current generator 40. Once the first node n41 is set to the operating voltage, the reset terminal is set to a low voltage level and the first NMOS transistor M31 is turned off. Therefore, the start-up circuit 30 does not affect other parts of the circuit.

If the first node n41 is set to a high voltage, the second NMOS transistor M43 of the reference current generator 40 is turned on, and the first and second PMOS transistors M41 and M42 are turned on. The third PMOS transistor M61 of the temperature compensator and current-to-voltage converter 60 is turned on. The operation of the circuit is determined by the third NMOS transistor M44 and the second resistor R42. The third node n43 has a value Vx irrespective of the supply voltage Vdd, and the constant current I independent of the supply voltage Vdd flows through each PMOS transistor. The reference current I flowing into the third PMOS transistor M61 of the temperature compensator and current-to-voltage converter 60 determines a voltage of the output node n61. Some current portion αI flows into the NMOS transistor M51 for Vbb variation effect cancelling, and the remaining current 1-αI flows into the fourth NMOS transistor M62.

If the substrate voltage Vbb varies, the threshold voltage of the third NMOS transistor M44 varies, which causes the voltage Vx of the third node n43 to vary. Therefore, the current I flowing into the current mirror is changed to I+ΔI, and the voltage state of the second node n42 varies. The fourth NMOS transistor M51 of the substrate voltage variation sensor 50 absorbs the variation of the current flowing into the third PMOS transistor M61 of the temperature compensator and current-to-voltage converter 60.

An absorption rate δ of the current variation is determined by optimizing the width-to-length (W/L) ratios of the fourth and third NMOS transistors M51 and M44 and a resistance ratio of the first and second resistors R41 and R42. The voltage difference ΔV at n43 caused by the Vbb variation through M44 is amplified ΔV (1+(R41/R42)). The fourth NMOS transistor M51, although it is also affected by the Vbb variation, cancels the current variation coming from M61. The ratio, R41/R42, should be set for M51 to cancel the current variation over the operating range of Vbb.

The current (1-αI) flows into the fourth PMOS transistor M62 in order to compensate for the variation of the reference voltage generated by the temperature variation. From the current-to-voltage relationship of the fourth PMOS transistor M62, the reference voltage $V_{ref}$ is:

$$V_{ref} = |V_{TP}| + \sqrt{\frac{L}{W}} \cdot \sqrt{\frac{(1-\alpha)\cdot I}{\beta_P}}$$

In the above equation, $V_{TP}$ is the threshold voltage of the fourth PMOS transistor M62, L/W is the length-to-width ratio of the fourth PMOS transistor M62, and β is a current factor (=2 u Cox, where μ is hole mobility and a constant Cox is a capacitance value per unit area by an insulation layer of transistor M62). The values I, $V_{TP}$ and $\beta_P$ are the functions of temperature. $|V_{TP}|$ has a negative TC (temperature coefficient) and $\beta_P$ has a strong negative TC. Therefore, the second term in the above equation has a positive TC, the value of which is controlled by L/W so that $V_{ref}$ shows a flat characteristic according to the temperature.

A DRAM (Dynamic Random Access Memory) requires the reference voltage generating circuit. As the integration of the DRAM increases and the voltage at the same class is lowered, the characteristic of the reference voltage generating circuit becomes more important. In an n-well process, the reference voltage generating circuit should generate a voltage independent of the variations in the supply voltage, the substrate voltage, the temperature, etc.

From this point of view, the reference voltage generating circuit embodying the present invention satisfies these requirements in the standard n-well process without an additional mask. In particular, in the voltage compensation according to the variation of temperature, an accurate voltage can be compensated by adjusting the W/L ratio of the PMOS transistor and the like. When applied to a higher density DRAM and an analog system, the effects will increase.

The foregoing embodiment is merely exemplary and not to be construed as limiting the present invention. The present scheme can be readily applied to other types of generators. One of ordinary skill in the art can use the teachings of the present invention to other devices requiring compensations due to substrate bias and temperature variations. The description of the present invention is intended to be illustrative, and not limiting the scope of the claims. Many alternatives, modifications and variations will be apparent to those skilled in the art.

We claim:

1. A reference voltage generating circuit of a semiconductor device for receiving a supply voltage, generating a reference current, and converting said reference current to a reference voltage to be supplied to an output terminal, said circuit comprising:

a start-up circuit, connected to a reset terminal, for generating a driving signal to a level of an operating point of said reference voltage generating circuit;

a reference current generator having a current mirror of a constant current source for receiving said driving signal from said start-up circuit and generating said reference current, and having a voltage divider for determining said reference current;

a substrate voltage variation sensor connected to said output terminal, for compensating a variation of said reference current caused by the variation of a substrate voltage;

a current-to-voltage converter for converting said reference current to said reference voltage, said current-to-voltage converter being driven together with said current mirror of said reference current generator; and a temperature compensator connected to said output terminal, for compensating the variation of said reference current according to the variation of temperature.

2. A reference voltage generating circuit of claim 1, wherein said start-up circuit comprises:

a first NMOS transistor having a source electrode connected to said supply voltage, a drain electrode connected to a first node of said reference voltage generator, and a gate electrode connected to said reset terminal.

3. A reference voltage generating circuit of claim 1, wherein said current mirror comprises:

first and second PMOS transistors having respective source electrodes commonly connected to said supply voltage, gate electrodes connected to each other, a drain electrode of said first PMOS transistor connected to said first node, said respective gate electrodes connected to a drain electrode of said second PMOS transistor, and a second NMOS transistor having a drain electrode connected to a drain electrode of said second PMOS transistor; and said voltage divider comprising:

a first resistor connected through a second node to a source electrode of said second NMOS transistor, a second resistor connected between said first resistor and a ground voltage, and a third NMOS transistor having a gate electrode connected to a third node between said first and second resistors, a drain electrode connected to said first node, and a source electrode connected to said ground voltage.

4. A reference voltage generating circuit of claim 1, wherein said substrate voltage variation sensor comprises:

an NMOS transistor having a source electrode connected to said ground voltage, a drain electrode connected to said output terminal, and a gate electrode connected to a sensing voltage.

5. A reference voltage generating circuit of claim 4, wherein said sensing voltage is a voltage of said second node between said voltage divider and said current mirror of said reference current generator.

6. A reference voltage generating circuit of claim 1, wherein said current-to-voltage generator comprises:

a third PMOS transistor having a gate electrode commonly connected to the respective gates of said first and second PMOS transistors, a source electrode connected to said supply voltage, and a drain electrode connected to said output terminal.

7. A reference voltage generating circuit of claim 1, wherein said temperature compensator comprises:

a fourth PMOS transistor having a source electrode connected to said output terminal, and gate and drain electrodes commonly connected to said ground voltage.

8. A circuit for generating a reference voltage comprising:

current generator having a current mirror to generate a predetermined current in response to a first predetermined signal at a first node;

a voltage sensor having a first transistor coupled to said current mirror of said current generator at a second node to detect a variation in the predetermined current; and a converter having a second transistor coupled to said first transistor of said voltage sensor, and an output terminal, and said second transistor coupled to said current mirror such that the predetermined current flows through said second transistor, wherein the reference voltage at said output terminal is based on the predetermined current flowing through said second transistor, and said first transistor absorbing the variation of the predetermined current due to a substrate bias voltage variation.

9. The circuit of claim 8, further comprising a start-up circuit coupled to said first node such that said start-up circuit generates the first predetermined signal to initiate the operation of said current generator.

10. The circuit of claim 9, wherein said start-up circuit comprises a third transistor having a first electrode receiving a predetermined voltage, a second electrode connected to said first node, and a control electrode receiving a first voltage such that said third transistor generates said first predetermined voltage.

11. The circuit of claim 8, wherein said current generator further comprises voltage divider coupled to said current mirror at said first and second nodes, said voltage divider comprising:

a third transistor coupled to said first node;

a first resistor coupled to said second node; and a second resistor coupled to said first resistor and third transistor at a third node.

12. The circuit of claim 11, wherein an absorption rate of the variation of said predetermined current is optimized by at least one of width and length (W/L) ratio of said first and third transistors and resistance ratio of said first and second resistors.

13. The circuit of claim 8, wherein said current mirror comprises:

a third transistor coupled to said first node;

a fourth transistor coupled to said first node and said second node; and a fifth transistor coupled to said fourth transistor, wherein gate electrodes of said third and fifth transistors are commonly connected to a gate electrode of said second transistor of said converter.

14. The circuit of claim 8, wherein said converter comprises:

a third transistor coupled to said second transistor at a fourth node such that said third transistor compensates for a variation of the reference voltage due to a temperature variation.

15. The circuit of claim 14, wherein said third transistor includes a first electrode coupled to said fourth node, and second and control electrodes which are commonly connected to one another.

16. The circuit of claim 8, further comprising a capacitor coupled to said first and second transistors.

17. A circuit for generating a reference voltage comprising:

current generator having a current mirror to generate a predetermined current in response to a first predetermined signal at a first node;

a voltage sensor, coupled to said current generator at a second node, for detecting a variation in the predetermined current; and a converter having a first transistor coupled to said voltage sensor, and an output terminal, said first transistor being coupled to said current mirror such that the predetermined current flows through said first transistor, and a second transistor coupled to said first transistor, wherein the reference voltage at said output terminal is based on the predetermined current flowing through said first transistor, and said first transistor compensates for a variation of the reference voltage due to a temperature variation.

18. The circuit of claim 17, further comprising a start-up circuit coupled to said first node such that said start-up circuit generates the first predetermined signal to initiate the operation of said current generator.

19. The circuit of claim 18, wherein said start-up circuit comprises a third transistor having a first electrode receiving a predetermined voltage, a second electrode connected to said first node, and a control electrode receiving a first voltage such that said third transistor generates said first predetermined voltage.

20. The circuit of claim 17, wherein said voltage sensor includes a third transistor coupled to a said current mirror of said current generator whereby said third transistor absorbs the variation of the predetermined current due to a substrate bias voltage variation.

21. The circuit of claim 20, wherein said current generator further comprises voltage divider coupled to said current mirror, said voltage divider comprising:

a fourth transistor coupled to said first node;

a first resistor coupled to said second node; and a second resistor coupled to said first resistor and third transistor at a third node.

22. The circuit of claim 21, wherein an absorption rate of the variation of said predetermined current is optimized by at least one of width and length (W/L) ratio of said third and fourth transistors and resistance ratio of said first and second resistors.

23. The circuit of claim 17, wherein said current mirror comprises:

a third transistor coupled to said first node;

a fourth transistor coupled to said first node and said second node; and a fifth transistor coupled to said fourth transistor, wherein gate electrodes of said third and fifth transistors are commonly connected to a gate electrode of said first transistor of said converter.

24. The circuit of claim 17, wherein said second transistor includes a first electrode coupled to said output terminal, and second and control electrodes which are commonly connected to one another.

25. The circuit of claim 17, further comprising a capacitor coupled to said first and second transistors.

* * * * *